United States Patent [19]

Kolotilo et al.

[11] 4,201,882

[45] May 6, 1980

[54] INDUCTION MELTING FURNACE

[76] Inventors: Daniil M. Kolotilo, ulitsa Akademika Dobrokhotova, 10, kv. 12, Kiev; Viktor V. Fursov, prospekt Pobedy, 39, kv. 19, Sevastopol; Anatoly A. Cherevaty, ulitsa Nadezhdintsev, 20, kv. 32, Sevastopol; Nikolai D. Mazovsky, prospekt Pobedy, 23, kv. 236, Sevastopol; Leonid M. Goncharov, ulitsa Letchikov, 87, kv. 44, Sevastopol; Larisa D. Apatova, ulitsa Akademika Dobrokhotova, 4, kv. 25, Kiev, all of U.S.S.R.

[21] Appl. No.: 903,779

[22] Filed: May 5, 1978

[51] Int. Cl.[2] ..... H05B 5/00

[52] U.S. Cl. ..... 13/27; 13/35

[58] Field of Search ..... 13/27, 26, 35

[56] References Cited

U.S. PATENT DOCUMENTS

| | | | |
|---|---|---|---|
| 3,185,894 | 5/1965 | Beckius | 13/27 X |
| 3,412,195 | 11/1968 | Mumper | 13/35 X |

FOREIGN PATENT DOCUMENTS

| | | |
|---|---|---|
| 1208451 | 5/1961 | Fed. Rep. of Germany . |
| 1220085 | 8/1963 | Fed. Rep. of Germany . |
| 1220086 | 7/1965 | Fed. Rep. of Germany . |
| 179663 | 6/1962 | Sweden . |
| 290919 | 1/1971 | U.S.S.R. . |
| 358602 | 11/1972 | U.S.S.R. . |
| 405008 | 10/1973 | U.S.S.R. . |

*Primary Examiner*—Roy N. Envall, Jr.

*Attorney, Agent, or Firm*—Haseltine, Lake & Waters

[57] ABSTRACT

An induction furnace intended for melting a metal which is disposed in a crucible in an alternating magnetic field developed by an inductor enveloping this crucible. Induced in the metal is a current which heats the latter. Fixedly mounted intermediate the crucible and the inductor on the outer surface of the latter is a heat-resistant current-conducting screen made from a carbon material of not more than 1.5 mm thick. The screen envelops the entire inner surface of the inductor and is electrically connected to a signal system intended to indicate the degree of wear of the crucible wall. The signal system is set to a predetermined voltage at which the furnace is shut down to avoid an emergency situation.

As the crucible walls wear out in the course of operation, the crucible resistance is therefore reduced, whereas the electrical potential in the crucible between the screen and metal is increased.

When a preset voltage is attained, the signal system is actuated to discontinue the furnace operation. As the metal which penetrates through the furnace wall to the screen solidifies, its passage towards the inductor is terminated.

The screen construction of the invention makes it possible to substantially enhance the furnace efficiency and to eliminate emergency situations.

6 Claims, 2 Drawing Figures

INDUCTION MELTING FURNACE

BACKGROUND OF THE INVENTION

1. Field of the application

The present invention relates to foundry practice, and more particularly to induction melting furnaces.

The invention is broadly applicable to adaptation in melting of cast iron and non-ferrous alloys.

Induction furnaces have found their greatest use in foundry practice.

2. Description of the prior art

The furnaces in question normally comprise a water-cooled cooper inductor accommodating a crucible formed by way of packing, drying and sintering powder-like oxidized materials. The sintered materials form a refractory lining made in the form of a tapered cylinder with a bottom wherein a metal is melted under the effect of alternating magnetic field induced by the inductor.

The power developed in the metal during induction heating depends on the amount of metal in the furnace and upon its physical properties (specific electrical resistance, relative permeability), as well as upon the frequency and strength of electromagnetic field.

In the course of metal melting, the refractory lining, subjected to thermochemical and mechanical effects of molten metal, is destroyed and the molten metal, getting onto the water-cooled inductor, causes the latter to melt down, while the water, coming into contact with the molten metal, causes vigorous vapor generation accompanied by metal splashing.

To prevent complete destruction of the furnace refractory lining, protecting means are used to signal the degree of the refractory lining destruction (wear-out) over its thickness. However, the protecting means in question are not effective enough, since they fail to provide full picture of the refractory lining destruction. This problem gave rise to extensive research work carried out in many countries with the purpose to develop effective signal systems intended to indicate the actual state of refractory linings, as well as means for protecting the furnace inductor.

The necessity to tackle the problem in hand is governed not only by technological and economic grounds, but by safety measures as well to be taken during metal splashing.

Therefore, the solution to the above-stated problems is to be sought after as follows:

by way of installing intermediate the crucible and inductor an electrode assembly intended to produce a signal through appropriate instruments indicating the degree of the refractory lining wear;

by way of interposing a heat-resistant screen between the inductor and refractory lining, intended to prevent molten metal from falling onto the inductor.

There are known induction furnaces which are provided (with the purpose of preventing molten metal from getting onto an inductor) with a copper cylinder mounted intermediate an inductor and a crucible, split along its generatrix and equal in height to the crucible (cf. U.S.S.R. Inventor's Certificate No. 405,008). It should be observed, however, that the water-cooled copper cylinder is complicated to manufacture; it is suitable only for a certain type of furnaces; it fails to prevent failure in operation when molten metal falls onto the water-cooled cylinder and causes burning-through thereof; the cylinder is inconvinient for mounting in the furnace and reduces the working space thereof.

The water-cooled cylinder protects the inductor from destruction, being, on the other hand, the source of failure due to molten metal penetration thereon.

U.S.S.R. Inventor's Certificate No. 290,919 discloses a control means having a metallized refractory glass fabric interposed between a refractory lining and the inductor insulation, operating to detect and signal the degree of wear of the induction furnace crucible. Although this means improves operating reliability of the induction furnace, it, however, fails to protect the inductor from destruction when molten metal penetrates thereto.

U.S.S.R. Inventor's Certificate No. 35,602 describes an alarm means which is used to control the state of the crucible refractory lining. This alarm means comprises two sets of open electrodes having opposite polarity and uniformly interposed between the layers of the crucible refractory lining over the entire circumferance and height thereof. The electrodes are alternately spaced apart from one another within the distance of 5 to 8 mm.

The disadvantage of the invention referred to above lies in that it offers control only over the state of the crucible refractory lining while failing to provide protection to the inductor from molten metal passed in the interspace between the electrodes.

The difficulty encountered in mounting and connecting electrodes as well as in packing the furnace with the electrodes having been arranged therein, renders the means under consideration impracticable. The interposition of the electrodes between the layers of the refractory lining reduces the furnace working capacity. Also, the control means is unsuitable to various types of furnaces.

FRG Patent No. 1,220,085 describes an induction furnace in which there is interposed between an induction coil and a packed crucible an insert made from a heat-resistnat material and tapered from the inductor side so that the thickness of its walls gradually increases from the bottom upwards. In the furnace of the patent referred to above the intermediary insert is used to prevent metal penetration (in case it is closed throughout the inductor perimeter from the top downwards). However, this insert fails to signal the penetration of metal through the refractory lining of the furnace bottom; it is complicated and expensive to manufacture, being unsuitable to various types of furnaces and reducing the furnace working space.

F.R.G. Patent No. 1,208,451 describes a means intended to signal destruction of the induction furnace melting crucible, comprising two substantially cylindrical electrodes insulated from each other and connected to a power source through a control instrument. The electrodes are basically coaxial metallic cylinders insulated from each other by means of a packing and fixed on the crucible exterior wall intermediate the crucible and the induction coil, the outer cylinder being fitted with more openings and insulated from the induction coil.

Though the coil means of the patent referred to above is capable of preventing metal penetration (in case it is closed through-out the inductor perimeter from the top downwards), it fails to signal metal penetration through the furnace bottom, affords no protection to the latter, it is complicated and expensive to manufacture, unsuitable for various types of furnaces, and reduces the furnace working space.

F.R.G. Patent No. 1,220,086 discloses a device intended to signal the onset of destruction and protecting a melting crucible from complete destruction, which is basically an electrode interposed in the layer of an insulation material between the crucible wall and an induction coil. The electrode is connected through a power source and an indicator to the inner surface of the crucible, being as well formed with longitudinal slots. At the sections disposed at the edges of the induction coils, the electrode is divided into longitudinal sections over its entire perimeter.

The signal means of the patent referred to above suffers from a number of disadvantages, i.e. it fails to afford protection to the inductor from metal penetration; it is expensive to manufacture and is unsuitable for various types of furnaces; also, it affords no protection to, and fails to signal the destruction of, the refractory lining of the furnace bottom.

From the description of the above-mentioned signal device it follows that it is not able to simultaneously afford protection to the furnace inductor from metal penetration and signal the degree of the refractory lining wear.

Therefore, the primary disadvantage of the prior-art signal device lies in that there still remains the danger of emergency even in the event of signal sent to indicate metal penetration to the electrode through the refractory lining.

Therefore, in cases like these the metal melting process is instantaneously terminated until complete cooling of metal in the crucible, which makes it difficult to remove the cooled metal from the furnace and prolongs the time period required to render the furnace operative again.

SUMMARY OF THE INVENTION

It is an object of the present invention to improve operating reliability of an induction melting furnace.

Another object of the invention is to improve safety measures required to enable touble-free service of an induction melting furnace.

Still another object of the invention is to enhance operating efficiency of an induction melting furnace.

These and other objects and features of the invention are accomplished by the provision of an induction melting furnace comprising a metal melting crucible disposed inside an inductor, and a heat-resistant current-conducting screen interposed between the crucible and the inductor and provided with a signal system intended to indicate the degree of wear of the crucible wall, wherein, according to the invention, the screen is formed by substantially solid wall made from a carbon material of not more than 1.5 mm in thickness and embracing the entire exterior surface of the crucible.

This invention provides the possibility for carrying out continuous control over the degree of wear of the crucible wall and affords reliable protection to the inductor from the molten metal that penetrates through the refractory lining. This enables the melting process to be completed and the molten metal to be discharged in the event of complete wear of the crucible. Small thickness of the heat-resistant screen permits the furnace working capacity to be increased, thereby enhancing its operating efficiency. In addition, the efficiency of the induction furnace of the invention is enhanced by way of increasing a permissible degree of wear of its refractory lining.

The heat resistant screen incorporated in the furnace of the invention improves explosion-proof conditions of the furnace operation, being readily applicable in all types of furnaces.

According to one embodiment of the invention, the screen is made of graphite fabric material.

According to another embodiment of the invention, the screen is made of graphitized paper.

To improve the screen durability, it is preferably impregnated with thermosetting resins containing amorphous boron.

BRIEF DESCRIPTION OF THE ACCOMPANYING DRAWINGS

The invention will be further described, by way of example only, with reference to the accompanying drawings, in which.

DESCRIPTION OF THE PREFERRED EMBODIMENT

Figure 1:
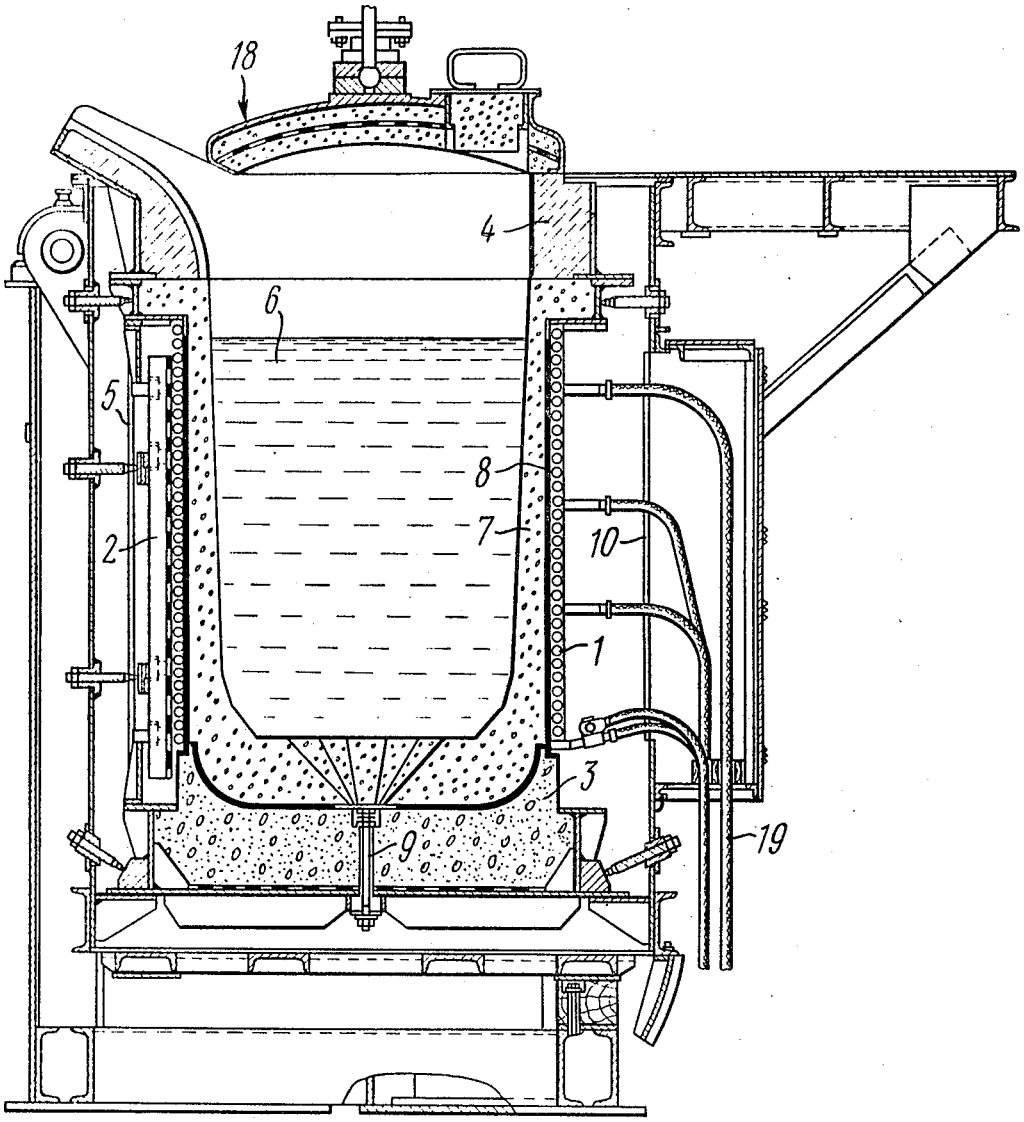
FIG. 1 is a longitudinal sectional view of an induction melting furnace according to the invention.

Referring now to the drawings, and to FIG. 1 in particular, the induction furnace of the invention comprises an inductor 1 surrounded by magnetic conductors 2. The inductor 1 is mounted on a refractory bottom plate 3. The magnetic conductors 2 are basically laminated sheets assembled from electrical steel, with an insulation being provided between the plates. The magnetic circuit may vary in construction.

As to their structure and designation, the magnetic conductors are divided into movable and stationary, serving to increase the magnetic field voltage.

The movable magnetic conductors are used to enable alignment and tightening of the inductor 1.

The stationary magnetic conductors 2 are used to increase magnetic field in the furnace.

Unlike the stationary magnetic conductors 2 mounted in space relationship to the inductor 1, the movable magnetic conductors are fitted with a layer of insulation tightly enveloping the inductor 1 and interposed between the movable magnetic conductors and the inductor 1.

To enable tightening of the vertically placed inductor 1 and to diminish its vibration, there are provided a strengthening ring 4 and the bottom plate 3 which are tightly interconnected by means of pins 5.

The furnace inductor 1 is water-cooled and is made of copper, conforming in shape to elongated segment. The water used for cooling of the inductor 1 is maintained at a temperature of not more than 65° to 75° C.

The melting of a metal 6 is carried out in a crucible 7. Interposed between the crucible 7 and the inductor 1 is a heat-resistant current-conducting screen 8 made of a graphite material and embracing the entire exterior surface of the crucible 7. The metal 6 in the crucible 7 is provided with a means 9 intended for its grounding.

The above-mentioned elements of the furnace are enclosed in a housing 10.

Figure 2:
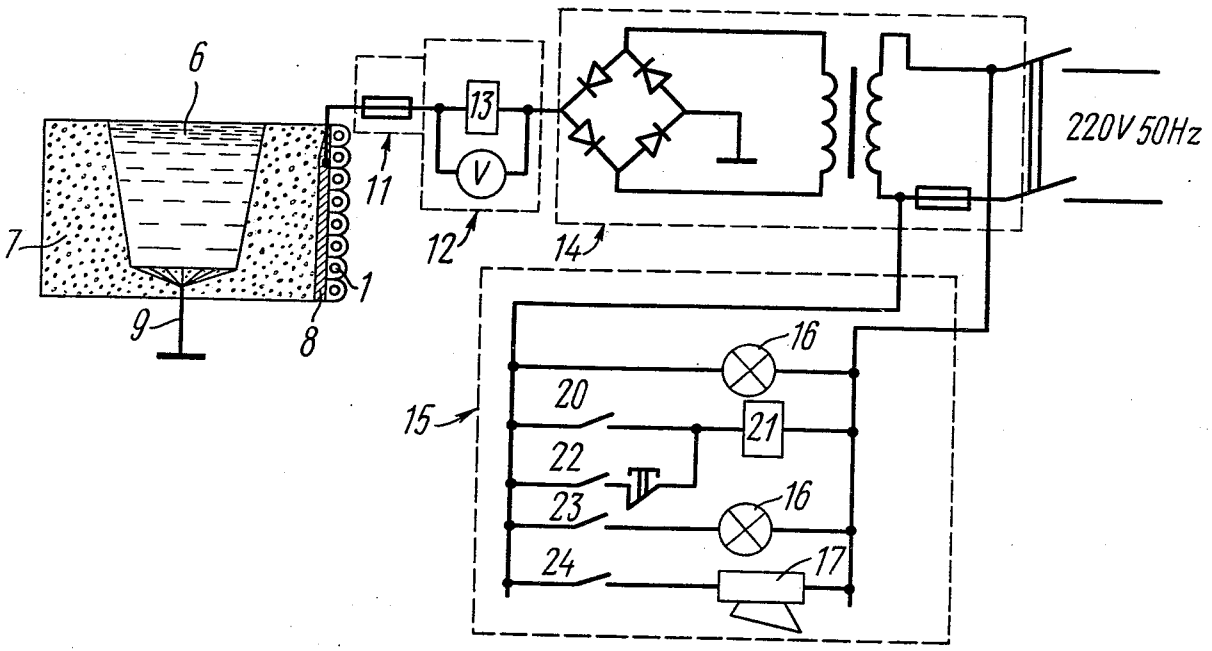
FIG. 2 is a block diagram of a signal system intended to indicate the degree of wear of the crucible wall.

To enable control over the degree of wear of the crucible 7, the furnace of the invention is provided with a signal system (FIG. 2) electrically connected to the screen 8. The signal system in question incorporates a safety unit 11 intended to project the signal system from overload. The signal system also comprises a monitor unit 12 which includes a relay 13, with a voltmeter being connected in parallel to the latter. The relay 13 is set to a predetermined voltage (determined on the basis of data received during test melts), at which the furnace is inoperative.

The unit 14 incorporates a stabilizer and a rectifying bridge. The signal circuit 15 includes signal elements (audible and light) 16 and 17.

The furnace of the invention is covered with a cover 18. Current supply to the inductor 1 is effected through tubes 19.

Prior to operation, the unit assembled from the inductor 1, bottom plate 3, strengthening ring 4, magnetic conductors 2 and tighened over its perimeter by means of the pins 5, is mounted in the furnace housing 10 and is then tightened by bolts (not shown) used to prevent vibration of the inductor 1. Mounted thereafter is the heat-resistant current-conducting screen 8 which is made of a graphite material having not more than 1.5 mm in thickness and enveloped from both ends thereof with a heat-insulating material. The graphite material in question may be, for example, graphite fabric material or graphitized paper. Both the graphite fabric material and graphitized paper are preferably impregnated with thermosetting resins containing amorphous boron. The resin impregnation is necessary to render graphite materials more resistant to oxidation.

The screen 8 is mounted in the following manner.

First, glued to the interior surface of the inductor 1 with the aid of silicone lacquer is an electrical insulation material (not shown), such as fabric glass or glass micanite, which is then dried at a temperature of 160° to 180° C., depending upon the silicone lacquer selected for the purpose. Mounted thereafter on the dried electrical insulation material is the screen 8 which is also subjected to heat treatment at a temperature of 160° to 180° C. whereupon it is connected to the above-mentioned signal system intended to indicate the degree of wear of the crucible 7.

After mounting the screen 8, the furnace of the invention is lined with a refractory, whereupon it is subjected to sintering. The sintering operation is conducted with the aid of heat developed by the magnetic field of the inductor 1 in accordance with a preset operating cycle.

As the crucible 7 undergoes sintering with the moisture being removed therefrom, the voltmeter of the monitoring unit 12 indicates voltage increase intermediate the metal 6 and the screen 8 due to the increase of electrical resistance of the refractory lining of crucible 7.

After the moisture is removed from the lining of the crucible 7, its resistance is at maximum and the monitored voltage ceases to rise, thereby attaining its optimal value.

In the course of the furnace operation the walls of the crucible 7 wear out with the resultant drop in electrical resistance of the crucible 7 and a rise in the electric potential between the screen 8 and the molten metal 6, registered by the voltmeter of the unit 12.

It has been found that the wall of the crucible 7 is subjected to most severe wear in the middle portion thereof and higher under the effect of the molten metal 6 stirring in that portion more vigorously and having higher temperature.

When a preset voltage is attained, the relay 13 operates, whereby the coil of the relay 21 is energized through the normally open contact 20 of the relay 13; and as the normally open contacts 22, 23, 24 of the relay 21 are closed, the signal elements 16, 17 of the signal circuit 15 operate.

The furnace is then shut down to allow repacking of its refractory.

The utilization of the heat-resistant screen 8 permits the relay 13 to be regulated so as to allow the molten metal 6 to come in direct contact with the heat-resistant current-conducting screen 8, thus making the most of the crucible 7.

Upon reaching the screen 8 the molten metal 6 is prevented from further travelling and thence solidifies without falling onto the surface of the inductor 1. The voltmeter of the unit 12 indicates zero, the metal 6 is discharged from the crucible 7, thus providing for trouble-free service.

What is claimed is:

1. An induction melting furnace comprising: a crucible for a molten metal; an inductor disposed around said crucible and inducing alternating magnetic field required to melt said metal; a heat-resistant current-conducting screen interposed between said inductor and crucible and enveloping the entire exterior surface of said crucible, said screen being formed by a substantially solid wall from a carbon material with a thickness thereof of not more than 1.5 mm, said screen preventing molten metal from reaching said inductor upon any destruction of the crucible lining; and circuit means connected to said screen for signalling predetermined wear of the crucible lining.

2. An induction melting furnace as claimed in claim 1, wherein said screen is made of graphite fabric material.

3. An induction melting furnace as claimed in claim 2, wherein said screen is made of graphitized paper.

4. An induction melting furnace as claimed in claim 1, wherein the carbon material used for said screen is impregnated with thermosetting resins containing amorphous boron.

5. An induction melting furnace as defined in claim 1 including signal circuit means connected to the entire external surface of said crucible for indicating the actual state of refractory linings.

6. An induction melting furnace as defined in claim 1 wherein said carbon material has a heat-resistance exceeding 2000° C.

* * * * *